US011536468B2

(12) United States Patent
Kawamura

(10) Patent No.: US 11,536,468 B2
(45) Date of Patent: Dec. 27, 2022

(54) INDOOR UNIT FOR AIR CONDITIONER

(71) Applicant: SHARP KABUSHIKI KAISHA, Sakai (JP)

(72) Inventor: Masaki Kawamura, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 417 days.

(21) Appl. No.: 16/629,412

(22) PCT Filed: Feb. 6, 2018

(86) PCT No.: PCT/JP2018/004057
§ 371 (c)(1),
(2) Date: Jan. 8, 2020

(87) PCT Pub. No.: WO2019/043984
PCT Pub. Date: Mar. 7, 2019

(65) Prior Publication Data

US 2020/0124295 A1 Apr. 23, 2020

(30) Foreign Application Priority Data

Aug. 30, 2017 (JP) ..... JP2017-166138

(51) Int. Cl.
*F24F 1/0063* (2019.01)
*F24F 1/0033* (2019.01)
*F24F 13/20* (2006.01)

(52) U.S. Cl.
CPC ..... *F24F 1/0063* (2019.02); *F24F 1/0033* (2013.01); *F24F 13/20* (2013.01)

(58) Field of Classification Search
CPC ..... F24F 1/0063; F24F 1/0033; F24F 13/20; F24F 2013/20
See application file for complete search history.

(56) References Cited

U.S. PATENT DOCUMENTS 3,306,070 A * 2/1967 Herb ..... F24F 13/20 62/426
4,548,050 A * 10/1985 Drucker ..... F24F 1/0063 62/291

(Continued)

FOREIGN PATENT DOCUMENTS

CN 201191042 Y 2/2009
CN 106949551 A 7/2017
JP 47-36809 Y1 11/1972

(Continued)

OTHER PUBLICATIONS

Written Opinion of ISA for PCT/JP2018/004057.

(Continued)

*Primary Examiner* — Joseph F Trpisovsky
(74) *Attorney, Agent, or Firm* — ScienBiziP, P.C.

(57) ABSTRACT

A heat exchanger placed in front of an air blower is appropriately supported by a cabinet. In an indoor unit, the heat exchanger is placed only in front of a rotation center of an air-blowing fan. The cabinet includes: an upper left protrusion and an upper right protrusion protruding forward from an upper portion of the cabinet; and a lower left protrusion and a lower right protrusion protruding forward from a lower portion of the cabinet, so that the protrusions support the heat exchanger.

7 Claims, 9 Drawing Sheets

(56) References Cited

U.S. PATENT DOCUMENTS

| | | | | |
|---|---|---|---|---|
| 6,324,859 | B1 * | 12/2001 | Tesche | F24F 13/20 62/262 |
| 2011/0277495 | A1 * | 11/2011 | Lee | F24F 1/0057 62/428 |

FOREIGN PATENT DOCUMENTS

| | | | |
|---|---|---|---|
| JP | S53-027349 | U | 3/1978 |
| JP | 53-82259 | U1 | 7/1978 |
| JP | 54-166765 | U | 11/1979 |
| JP | 56-139919 | U | 10/1981 |
| JP | 59-040728 | U | 3/1984 |
| JP | S60-130323 | U | 8/1985 |
| JP | S60-138116 | U | 9/1985 |
| JP | 2006-214670 | A | 8/2006 |
| JP | 2016-156512 | A | 9/2016 |
| JP | 6411238 | B2 | 10/2018 |
| KR | 2006-0109161 | A | 10/2006 |

OTHER PUBLICATIONS

Office Action of Japanese Patent Application No. 2019-538934 dated Jan. 25, 2022.
Office Action for Application No. P-00 2020 01550 dated Aug. 4, 2021.

* cited by examiner

INDOOR UNIT FOR AIR CONDITIONER

TECHNICAL FIELD

The present invention relates to an indoor unit, for an air conditioner, including a heat exchanger.

TECHNICAL FIELD

A conventional indoor unit for an air conditioner includes inside: an air blower; and a heat exchanger surrounding an upper portion and a front portion of the air blower, as disclosed, for example, in Patent Document 1. In such an indoor unit, the air blower rotates to suck air from an inlet in an upper portion of the indoor unit. The sucked air passes through the heat exchanger, and then blows out from an outlet in a front-lower portion of the indoor unit.

Moreover, in the indoor unit, the heat exchanger as a heavy load has: a rear portion inserted in a housing formed in the rear of a cabinet; and left and right side portions each secured to respective protrusions formed on the left and right of the cabinet. In the indoor unit, such a structure allows the cabinet to support the heat exchanger.

CITATION LIST

Patent Document

[Patent Document 1] Japanese Unexamined Patent Application Publication No. 2006-214670

SUMMARY OF INVENTION

Technical Problem

An air conditioner recently developed is capable of purifying air in addition to conditioning air. For example, a high efficiency particulate air filter (HEPA filter) has a large air-flow resistance. Hence, the use of the HEPA filter for air purification inevitably reduces a volume of air blowing from the outlet. When the HEPA filter is used for air purification, it is necessary to secure a sufficient volume of the air (a sufficient volume of the air to be sucked).

Hence, as to the indoor unit, one example of the solutions is to form an inlet for air conditioning and an inlet for air purification in an upper portion and a lower portion of the indoor unit, and the heat exchanger is provided in front of the air blower.

However, the heat exchanger provided in front of the air blower keeps from the use of the conventional structure for supporting the heat exchanger.

Hence, an aspect of the present invention is intended to provide an indoor unit, for an air conditioner, capable of appropriately supporting a heat exchanger with a cabinet when the heat exchanger is provided in front of an air blower.

Solution to Problem

In order to solve the above problem, an indoor unit, for an air conditioner, according to an aspect of the present invention includes: a heat exchanger, an inlet, an outlet, an air-blowing fan, and a cabinet, wherein the heat exchanger is placed only in front of a rotation center of the air-blowing fan, the inlet is provided in rear of the heat exchanger, the outlet is provided in front of the heat exchanger, the air-blowing fan blows air, sucked from the inlet, at the heat exchanger, and blows the air out from the outlet, and the cabinet includes: an upper protrusion protruding forward from an upper portion of the cabinet; and a lower protrusion protruding forward from a lower portion of the cabinet, the upper protrusion and the lower protrusion supporting the heat exchanger.

Advantageous Effects of Invention

An aspect of the present invention achieves advantageous effects: even though the heat exchanger is placed only in front of the rotation center of the air-blowing fan; that is, even though the heat exchanger is placed in front of the air blower, the cabinet can appropriately support the heat exchanger.

BRIEF DESCRIPTION OF DRAWINGS

FIG. 3 (*b*) is a schematic side view of the indoor unit, illustrating conditions of the open-close lid and the air guiding plate when the air conditioner is in an air-conditioning mode and set cooling. FIG. 3 (*c*) is a schematic side view of the indoor unit, illustrating conditions of the open-close lid and the air guiding plate when the air conditioner is in an air purification mode and set cooling.

FIG. 7 (*b*) is a schematic bottom view illustrating the structure for supporting the heat exchanger by the cabinet.

FIG. 8 (*b*) is a schematic bottom view illustrating the structure for supporting the heat exchanger by the cabinet.

FIG. 9 (*b*) is a schematic bottom view illustrating the structure for supporting the heat exchanger with the cabinet.

FIG. 10 (*b*) is a front elevation of the cabinet. FIG. 10 (*c*) is a bottom view of the cabinet. FIG. 10 (*d*) is a rear elevation of the cabinet.

FIG. 11 (*b*) is a schematic bottom view illustrating the structure for supporting the heat exchanger by the cabinet.

DESCRIPTION OF EMBODIMENTS

First Embodiment

Figure 1:
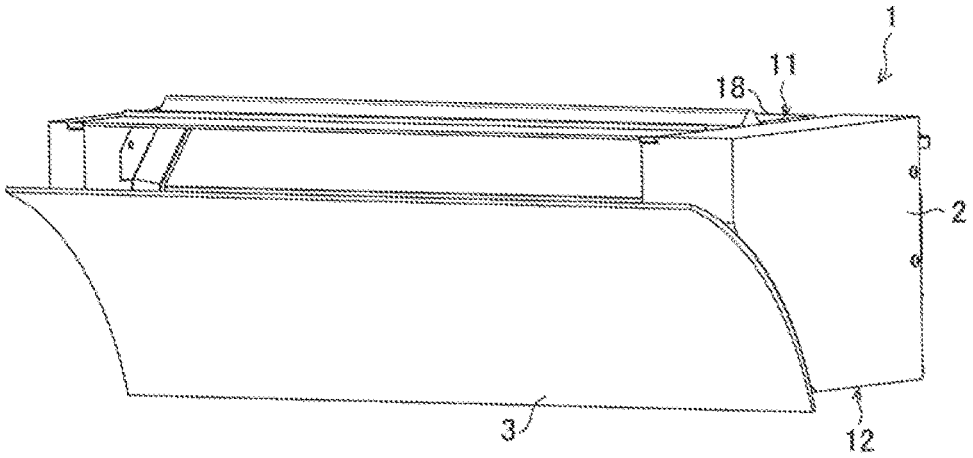
FIG. 1 is a perspective view illustrating an appearance of an indoor unit for an air conditioner according to an embodiment of the present invention.
Figure 2:
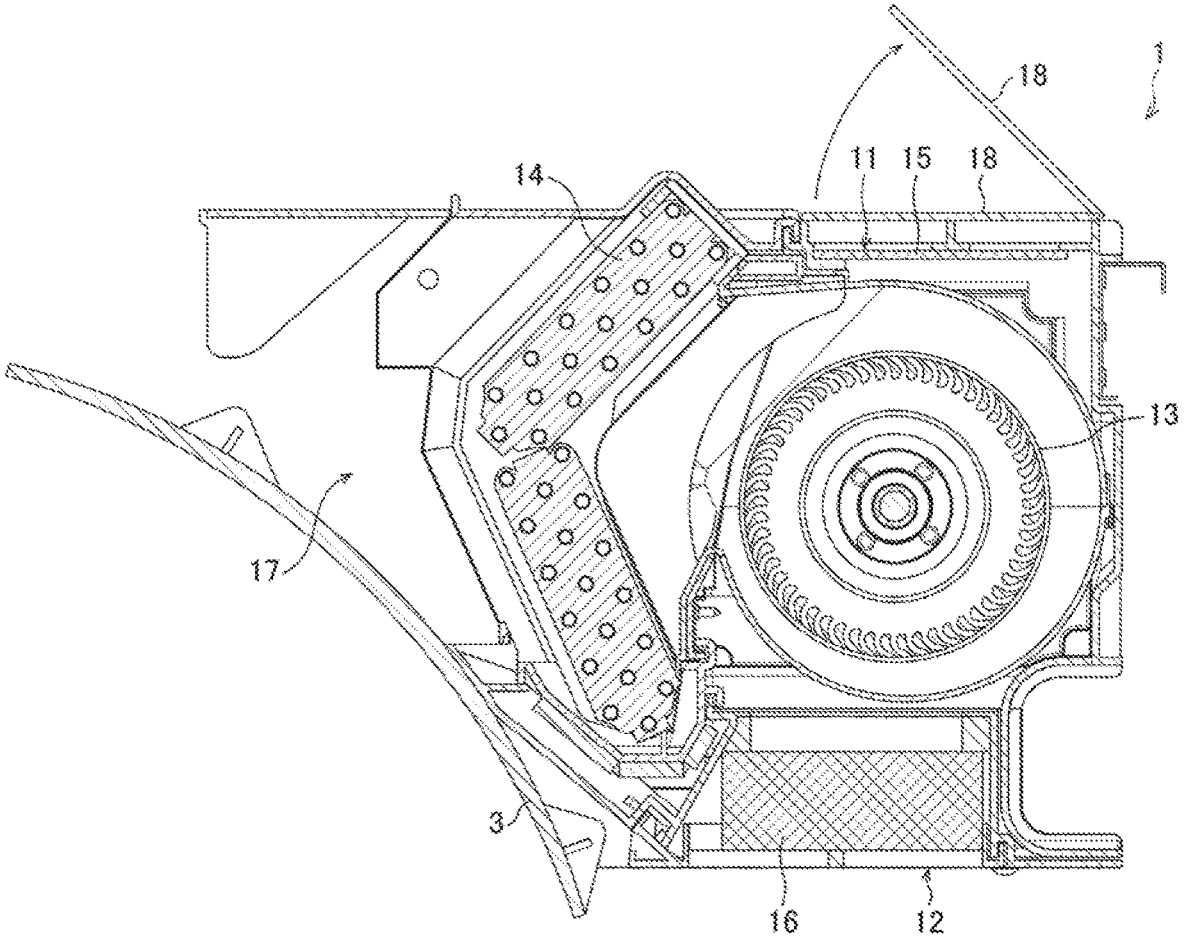
FIG. 2 is a vertical cross-sectional view of the indoor unit illustrated in FIG. 1.

Described below are embodiments of the present invention, with reference to the drawings. FIG. 1 is a perspective view illustrating an appearance of an indoor unit 1 for an air conditioner according to this embodiment. FIG. 2 is a vertical cross-sectional view of the indoor unit 1 for the air conditioner illustrated in FIG. 1.

(Outline of Indoor Unit 1)

As illustrated in FIG. 1, the indoor unit 1 of the air conditioner includes an air guiding plate 3 in front of an indoor-unit body 2. As illustrated in FIG. 2, the indoor-unit body 2 includes: a first inlet 11 in an upper portion thereof; a second inlet 12 in a lower portion thereof; an air-blowing fan 13 and a heat exchanger 14 therein; and an outlet 17 in a front portion thereof.

Moreover, the indoor unit 1 includes: a first filter 15 inside (below) the first inlet 11; and a second filter 16 inside (above) the second inlet 12. For example; the first filter 15 is functionally equivalent to a prefilter, and lower in performance, and smaller in air-flow resistance, than the second filter 16. For example, the second filter 16 is an HEM filter, and higher in performance, and greater in air-flow resistance, than the first filter 15.

In the indoor unit 1, the air sucked from the first inlet 11 passes through the first filter 15, the air-blowing fan 13, and the heat exchanger 14, and blows out from the outlet 17, Furthermore, the air sucked from the second inlet 12 passes through the second filter 16, the air-blowing fan 13, and the heat exchanger 14, and blows out from the outlet 17.

Figure 3:
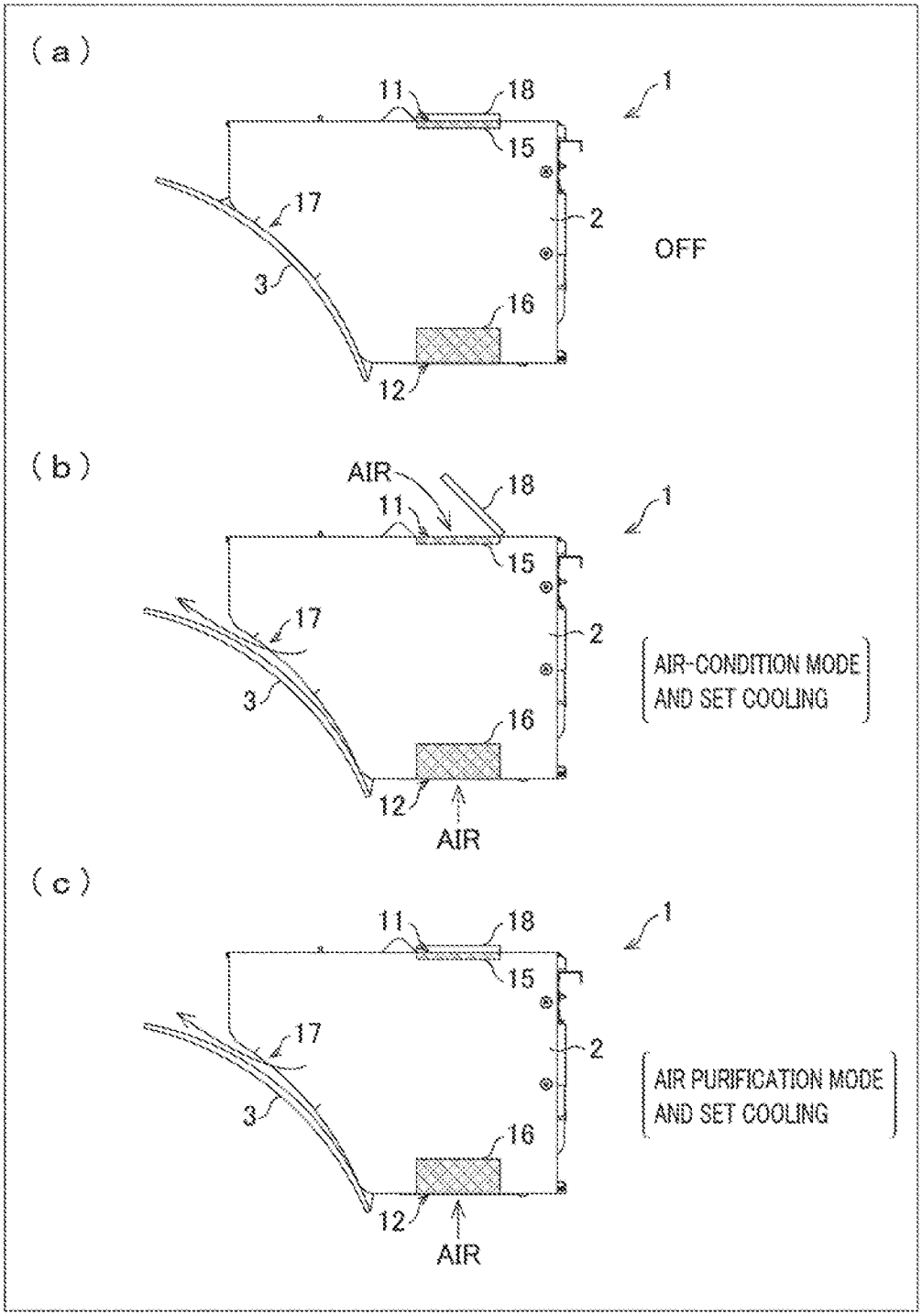
FIG. 3 (*a*) is a schematic side view of the indoor unit, illustrating conditions of an open-close lid and an air guiding plate when the air conditioner of the embodiment is OFF.

The first inlet 11 is provided with an open-close lid 18 opening and closing the first inlet 11. FIG. 3 (*a*) is a schematic side view of the indoor unit 1, illustrating conditions of the open-close lid 18 and the air guiding plate 3 when the air conditioner is OFF. FIG. 3 (*b*) is a schematic side view of the indoor unit 1, illustrating conditions of the open-close lid 18 and the air guiding plate 3 when the air conditioner is in an air-conditioning mode and set cooling. FIG. 3 (*c*) is a schematic side view of the indoor unit, illustrating conditions of the open-close lid 18 and the air guiding plate 3 when the air conditioner is in an air purification mode and set cooling.

As illustrated in FIG. 3 (*a*), the open-close lid 18 is closed when the air conditioner is OFF. Moreover, as illustrated in FIG. 3 (*b*), the open-close lid 18 is open when the air conditioner operates, prioritizing air conditioning over air purification (in the air-conditioning mode). Furthermore, as illustrated in FIG. 3 (*c*), the open-close lid 18 is closed when the air conditioner operates, prioritizing air purification over air conditioning (in the air purification mode).

An example of the air-blowing fan 13 may include a sirocco fan or a turbo fan.

The heat exchanger 14 includes two heat exchangers vertically connected together with the connection of the two heat exchangers protruding forward (in a dogleg shape), and provided in front of the air-blowing fan 13 (closer to the front of the indoor unit 1 than the air-blowing fan 13 is). Specifically, the heat exchanger 14 is placed only in front of the indoor unit 1 in relation to a rotation shaft 13*a* of the air-blowing fan 13 (see FIG. 4)

(Structure of Indoor-Unit Body 2)

Figure 4:
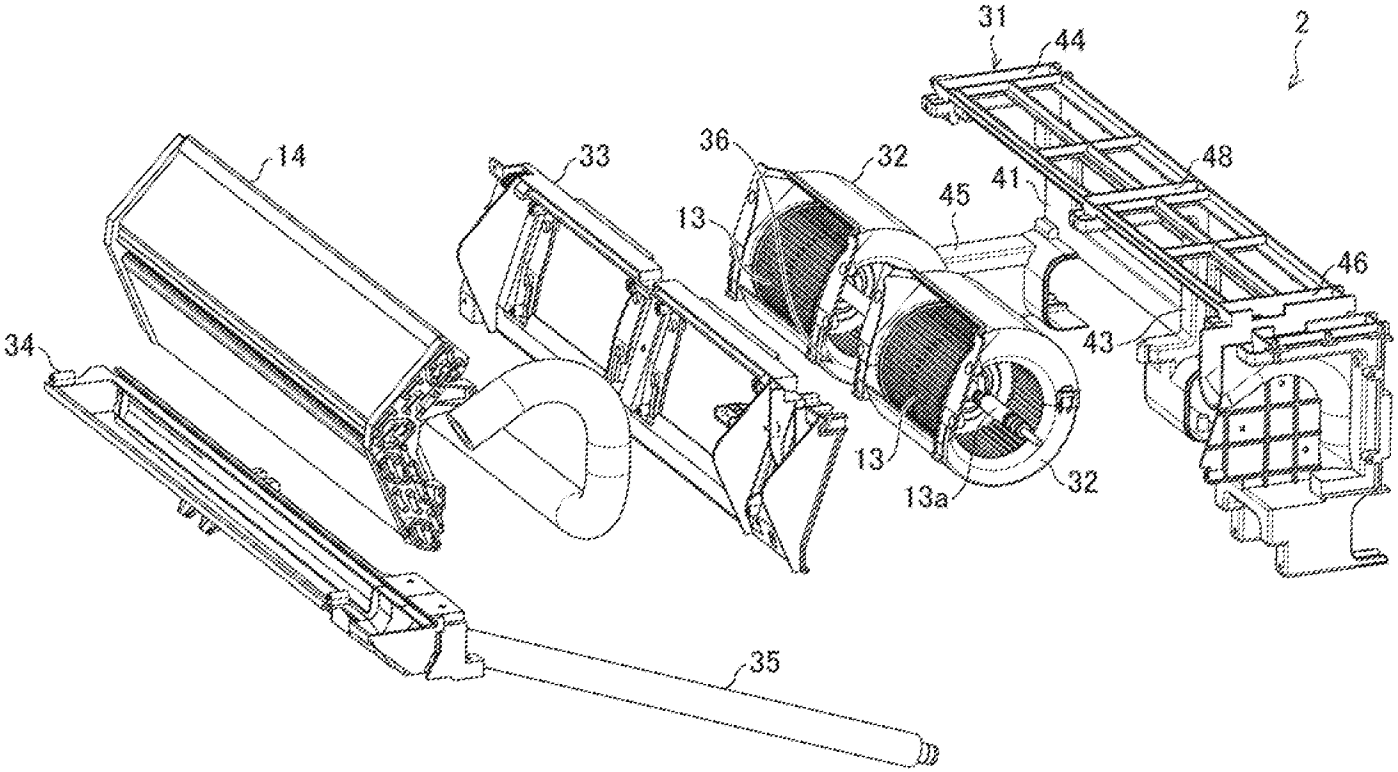
FIG. 4 is an exploded perspective view of main components included in a body of the indoor unit illustrated in FIG. 1.
Figure 5:
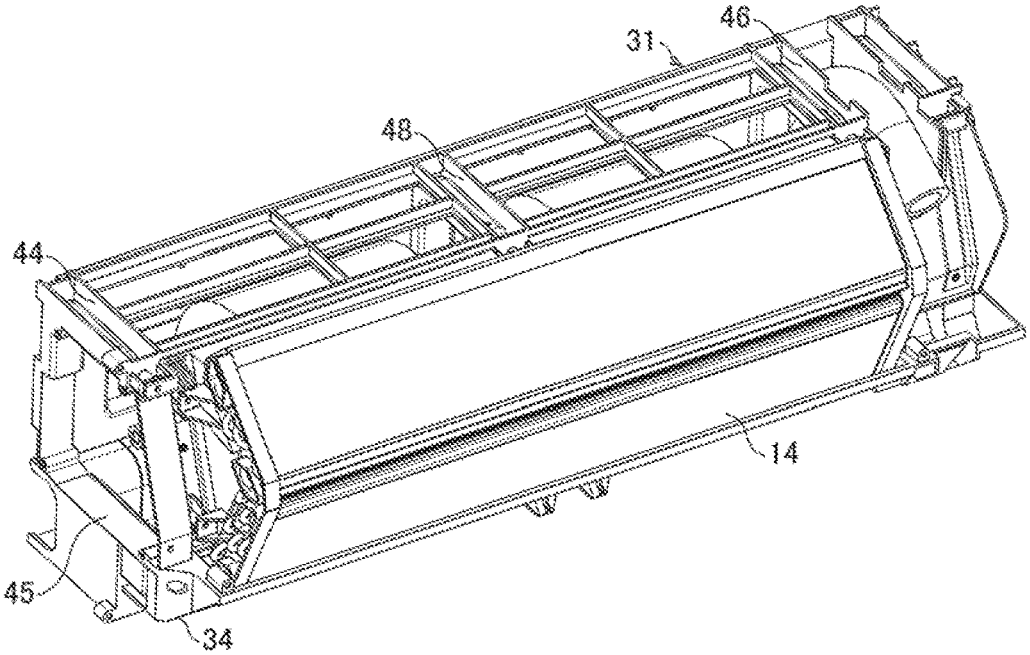
FIG. 5 is a perspective view illustrating the main components in FIG. 4 assembled.
Figure 6:
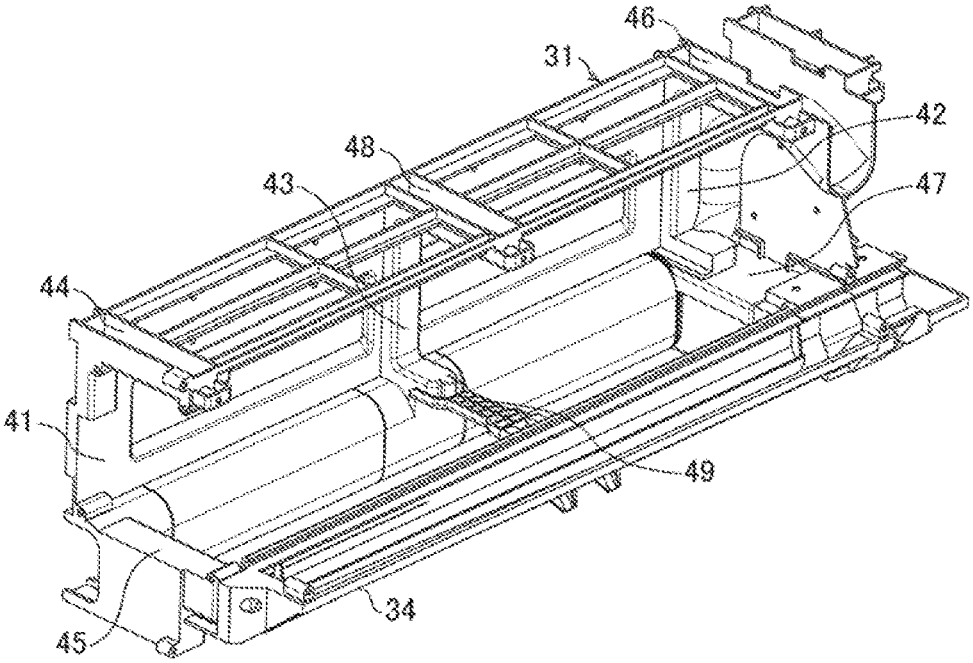
FIG. 6 is a perspective view illustrating the assembled main components in FIG. 5 with a fan casing, an air-blowing fan, a partition plate, and a heat exchanger removed.

FIG. 4 is an exploded perspective view of main components included in the indoor-unit body 2 illustrated in FIG. 1. FIG. 5 is a perspective view illustrating the main components in FIG. 4 assembled. FIG. 6 is a perspective view illustrating the assembled main components in FIG. 5 with a fan casing 32, the air-blowing fan 13, a partition plate (a heat exchanger attachment) 33, and the heat exchanger 14 removed.

As illustrated in FIG. 4, the indoor-unit body 2 includes a cabinet 31, the fan casing 32, the air-blowing fan 13, the partition plate 33, the heat exchanger 14, and a drain pan 34.

The cabinet 31 is provided in a rear portion of the indoor unit 1, and supports the fan casing 32, the air-blowing fan 13, the partition plate 33, the heat exchanger 14, and the drain pan 34.

As illustrated in FIGS. 4 to 6, when observed from the front of the indoor unit 1, the cabinet 31 includes: a vertical left column 41 provided to a left end of the cabinet 31; an upper left protrusion (an upper protrusion) 44 extending forward from an upper portion of the vertical left column 41; and a lower left protrusion (a lower protrusion) 45 extending forward from a lower portion of the vertical left column 41.

Moreover, when observed from the front of the indoor unit 1, the cabinet 31 includes: a vertical right column 42 provided to a right end of the cabinet 31; an upper right protrusion (an upper protrusion) 46 extending forward from an upper portion f the vertical right column 42; and a lower right protrusion (a lower protrusion) 47 extending forward from a lower portion of the vertical right column 42.

Furthermore, the cabinet 31 includes: a vertical middle column 43 between the vertical left column 41 and the vertical right column 42; an upper middle protrusion (an upper protrusion) 48 extending forward from an upper portion of the vertical middle column 43; and a lower middle protrusion (a lower protrusion) 49 extending forward from a lower portion of the vertical middle column 43. The lower middle protrusion 49 is screwed to the vertical middle column 43, and can be unscrewed under, and removed from, the cabinet 31.

The cabinet 31 has a space defined between (i) the upper left protrusion 44, the upper right protrusion 46, and the upper middle protrusion 48 and (ii) the lower left protrusion 45, the lower right protrusion 47, and the lower middle protrusion 49, such that the space includes the fan casing 32. The fan casing 32 houses the air-blowing fan 13. The fan casing 32 includes two fan casings 32 in total; that is, one to the left of the upper middle protrusion 48 and another one to the right of the lower middle protrusion 49. Each of the fan casings 32 is provided with the air-blowing fan 13. The center of two air-blowing fans 13, included in the air-blowing fan 13, is provided with the rotation shaft 13*a*.

A space between the two fan casings 32 acts as a motor accommodation 36. The motor accommodation 36 is provided with a not-shown fan motor to rotate the air-blowing fans 13 (the rotation shaft 13*a* of the air-blowing fans 13). The fan motor here is a dual-shaft motor having rotation shafts longitudinally aligned.

The drain pan 34 is screwed to the cabinet 31; that is, the drain pan 34 is screwed to the front ends of, and supported by, the lower left protrusion 45, the lower right protrusion 47, and the lower middle protrusion 49. To the drain pan 34, a drain pipe 35 is connected. Water generated by the heat exchanger 14 is received in the drain pan 34, and ejected through the drain pipe 35.

The partition plate 33 is provided in front of the cabinet 31 and above the drain pan 34, The partition plate 33 is connected to the cabinet 31; that is, the partition plate 33 is connected to the front ends of the upper left protrusion 44, the upper right protrusion 46, the upper middle protrusion 48, the lower left protrusion 45, the lower right protrusion, 47, and the lower middle protrusion 49. Hence, the partition plate 33 is supported by the six protrusions 44 to 49 of the cabinet 31.

The heat exchanger 14 is provided in front of, and secured to, the partition plate 33. The heat exchanger 14 is the heaviest load of all the components included in the indoor unit 1. In the indoor unit 1, the heat exchanger 14; namely a heavy load, is placed in front of the cabinet 31, such that the center of gravity of the indoor unit 1 is positioned forward.

(Structure for Supporting Heat Exchanger 14 by Cabinet 31)

Figure 7:
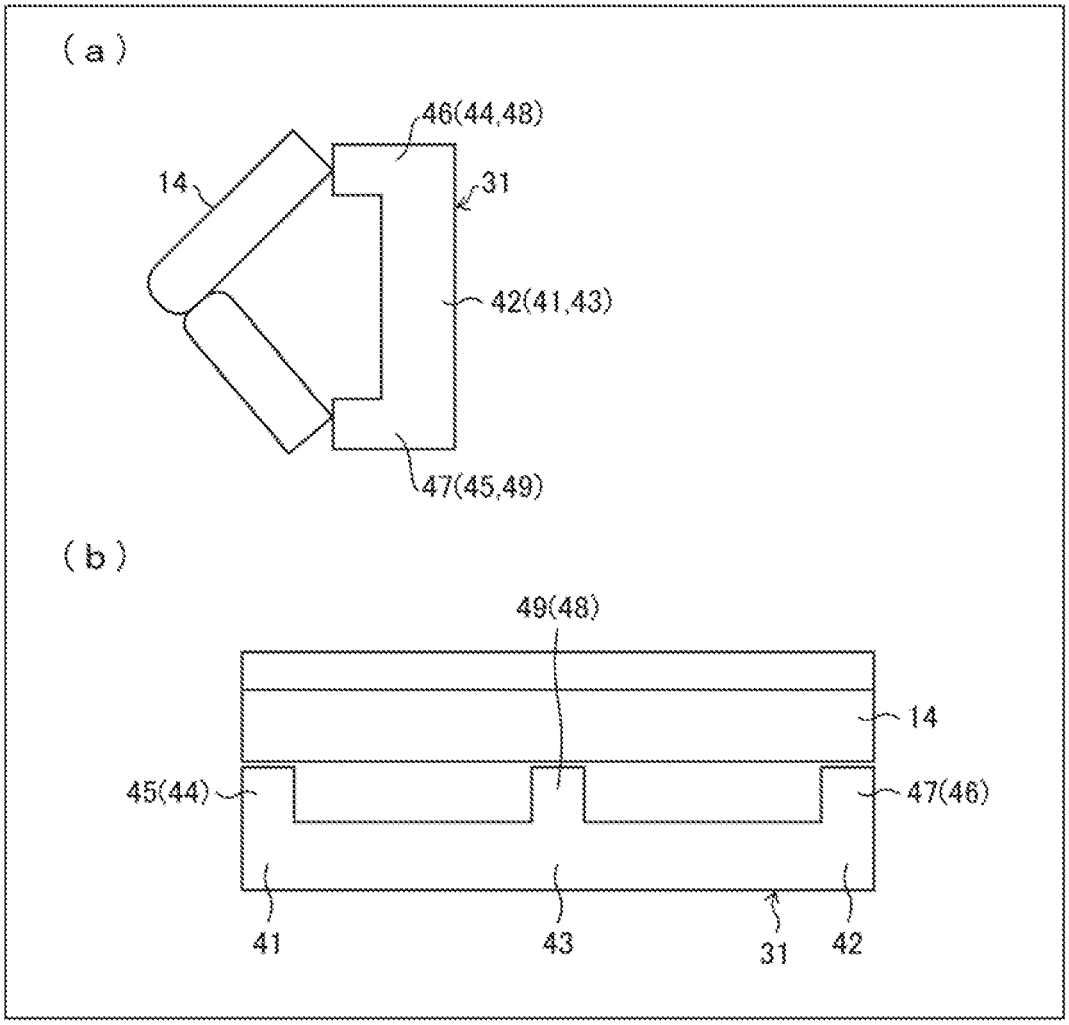
FIG. 7 (*a*) is a schematic side view illustrating a structure for supporting the heat exchanger by a cabinet illustrated in FIG. 4.

Briefly described here is a structure for supporting the heat exchanger 14 by the cabinet 31 of the indoor unit 1 of this embodiment. FIG. 7 (*a*) is a schematic side view illustrating the structure for supporting the heat exchanger 14 by the cabinet 31. FIG. 7 (*b*) is a schematic bottom view illustrating the structure for supporting the heat exchanger 14 by the cabinet 31. Note that, in FIGS. 7 (*a*) and (*b*), the reference sings of the hidden and invisible vertical columns and protrusions are denoted in brackets. The same goes for the other embodiments.

In the indoor unit 1 of this embodiment, the partition plate 33 is supported by the six protrusions of the cabinet 31; namely, the upper left protrusion 44, the lower left protrusion 45, the upper right protrusion 46, the lower right protrusion 47, the upper middle protrusion 48, and the lower middle protrusion 49. The heat exchanger 14 is secured to the partition plate 33 (see FIG. 6). Hence, as illustrated in FIGS. 7 (*a*) and (*b*), the heat exchanger 14 is substantially supported by the six protrusions 44 to 49 of the cabinet 31. These protrusions 44 to 49 function as beams.

Moreover, the partition plate 33 is placed between the cabinet 31 and the heat exchanger 14 to facilitate positioning of the heat exchanger 14 in front of the cabinet 31. Hence, the partition plate 33 is not essential in view of the structure for supporting the heat exchanger 14 by the cabinet 31. As illustrated in FIGS. 7 (*a*) and (*b*), the partition plate 33 may be omitted.

Note that it is not essential for the indoor unit 1 of this embodiment to be capable of purifying air. Hence, in the case where the indoor-unit body 2 does not include the second filter 16 for purifying air (an HEPA filter, for example), the indoor-unit body 2 may have at least one inlet (at least one of the first inlet 11 or the second inlet 12 in this embodiment), and the inlet may be provided with the first filter 15. Furthermore, the at least one inlet, the first inlet 11, and the second inlet 12 do not have to be placed in the upper portion or the lower portion of the indoor-unit body 2. Alternatively, these inlets may be placed in the rear of the indoor-unit body 2 behind the heat exchanger 14. The same goes for the other embodiments.

(Advantages of Indoor Unit)

As to the indoor unit 1 of this embodiment, in the fore-aft direction of the indoor-unit body 2, the air sucked from an inlet (the first inlet 11 and the second inlet 12) in rear of the heat exchanger 14 is blown by the air-blowing fan 13 at the heat exchanger 14, and the air is blown out from the outlet 17 placed in front of the heat exchanger 14.

Here, in the configuration illustrated in FIGS. 7 (*a*) and (*b*), the heat exchanger 14 placed in front of the cabinet 31 is supported by (i) the upper left protrusion 44 and the lower left protrusion 45 protruding forward on the observer's left of the cabinet 31, (ii) the upper right protrusion 46 and the lower right protrusion 47 protruding forward on the observer's right of the cabinet 31, and (iii) the upper middle protrusion 48 and the lower middle protrusion 49 protruding forward in the middle of the cabinet 31, Such a configuration allows the cabinet 31 to stably support the heat exchanger 14 placed in front of the cabinet 31.

Moreover, the lower middle protrusion 49 is screwed to the vertical middle column 43, and can be unscrewed under, and removed from, the cabinet 31. Hence, with the lower middle protrusion 49 removed, the air-blowing fan 13 and the fan motor placed in the cabinet 31 between (i) the upper left protrusion 44 and the lower left protrusion 45 and (ii) the upper right protrusion 46 and the lower right protrusion 47 can be easily taken out downward between the lower left protrusion 45 and the lower right protrusion 47. Such a configuration facilitates work for removing, for example, the air-blowing fan 13 to be cleaned, or the fan motor to be repaired.

Furthermore, in the configuration including the partition plate 33, the heat exchanger 14 is mounted on the partition plate 33. The partition plate 33 is supported by the upper left protrusion 44, the lower left protrusion 45, the upper right protrusion 46, the lower right protrusion 47, the upper middle protrusion 48, and the lower middle protrusion 49 of the cabinet 31. Such a configuration makes it possible to place the heat exchanger 14 in front of the cabinet 31.

Moreover, the heat exchanger 14 is placed above the drain pan 34. The drain pan 34 is connected to, and supported by, the lower left protrusion 45, the lower right protrusion 47, and the lower middle protrusion 49 of the cabinet 31. In the indoor unit 1, such a configuration allows the cabinet 31 to stably support the heat exchanger 14.

Second Embodiment

Described below is another embodiment of the present invention, with reference to the drawings. Note that, for the sake of explanation, identical reference signs are used to denote components with identical functions between the first and second embodiments. Such components will not be elaborated upon here.

(Structure for Supporting Heat Exchanger 14 by Cabinet 61)

Figure 8:
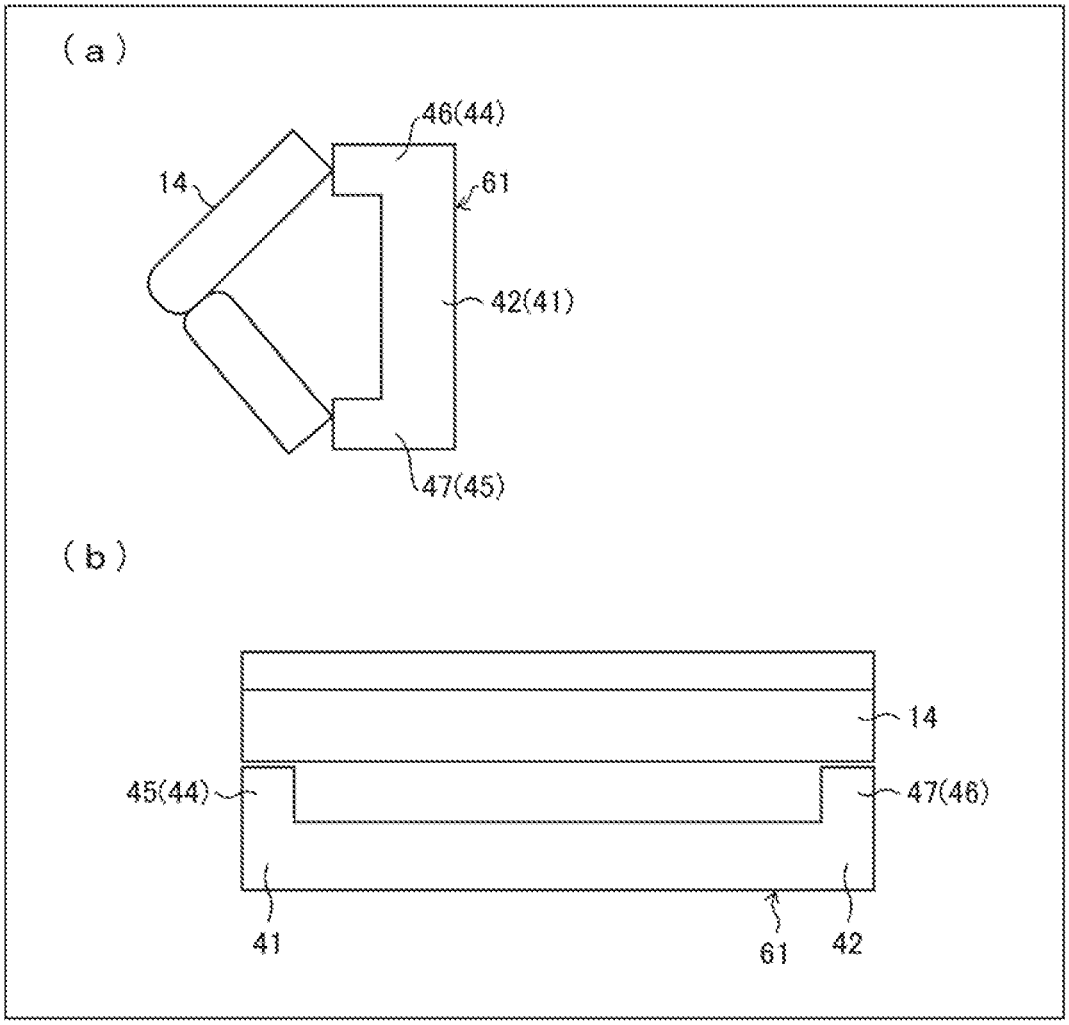
FIG. 8 (*a*) is a schematic side view illustrating a structure for supporting the heat exchanger by a cabinet of the indoor unit according to another embodiment of the present invention.

FIG. 8 (*a*) is a schematic side view illustrating a structure for supporting the heat exchanger 14 by a cabinet 61 of the indoor unit 1 according to this embodiment. FIG. 8 (*b*) is a schematic bottom view illustrating the structure for supporting the heat exchanger 14 by the cabinet 61.

The indoor unit 1 of this embodiment includes the cabinet 61 instead of the cabinet 31. As illustrated in FIGS. 8 (*a*) and (*b*), in the indoor unit 1 of this embodiment, the heat exchanger 14 is supported by four protrusions of the cabinet 61; namely, the upper left protrusion 44, the lower left protrusion 45, the upper right protrusion 46, and the lower right protrusion 47. Similar to the first embodiment, the heat exchanger 14 may be mounted on the partition plate 33 (see FIG. 6) and supported by the cabinet 61 through the partition plate 33. The same goes for the other embodiments below.

Note that, in this embodiment, the partition plate 33 is supported by the upper left protrusion 44, the lower left protrusion 45, the upper right protrusion 46, and the lower right protrusion 47 of the cabinet 61. Moreover, the drain pan 34 is connected to, and supported by, the lower left protrusion 45 and the lower right protrusion 47 of the cabinet 61.

(Advantages of Indoor Unit)

As to the indoor unit 1 of this embodiment, in the fore-aft direction of the indoor-unit body 2, the air sucked from an inlet (the first inlet 11 and the second inlet 12) in rear of the heat exchanger 14 is blown by the air-blowing fan 13 at the heat exchanger 14, and the air is blown out from the outlet 17 located in front of the heat exchanger 14.

Here, in the configuration illustrated in FIGS. 8 (*a*) and (*b*), the heat exchanger 14 placed in front of the cabinet 61 is supported by (i) the upper left protrusion 44 and the lower left protrusion 45 protruding forward on the observer's left of the cabinet 61, and (ii) the upper right protrusion 46 and the lower right protrusion 47 protruding forward on the observer's right of the cabinet 61. Such a configuration allows the cabinet 61 to stably support the heat exchanger 14 placed in front of the cabinet 61.

Moreover, the air-blowing fan 13 and the fan motor placed in the cabinet 61 between (i) the upper left protrusion 44 and the lower left protrusion 45 and (ii) the upper right protrusion 46 and the lower right protrusion 47 can be easily taken out downward between the lower left protrusion 45 and the lower right protrusion 47. Such a configuration facilitates work for removing, for example, the air-blowing fan 13 to be cleaned, or the fan motor to be repaired. The other advantages of the indoor unit 1 according to this embodiment are the same as those of the indoor unit 1 including the cabinet 31 according to the first embodiment.

Third Embodiment

Described below is still another embodiment of the present invention, with reference to the drawings. Note that, for the sake of explanation, identical reference signs are used to denote components with identical functions between the preceding embodiments and a third embodiment. Such components will not be elaborated upon here.

(Structure for Supporting Heat Exchanger 14 by Cabinet 62)

Figure 9:
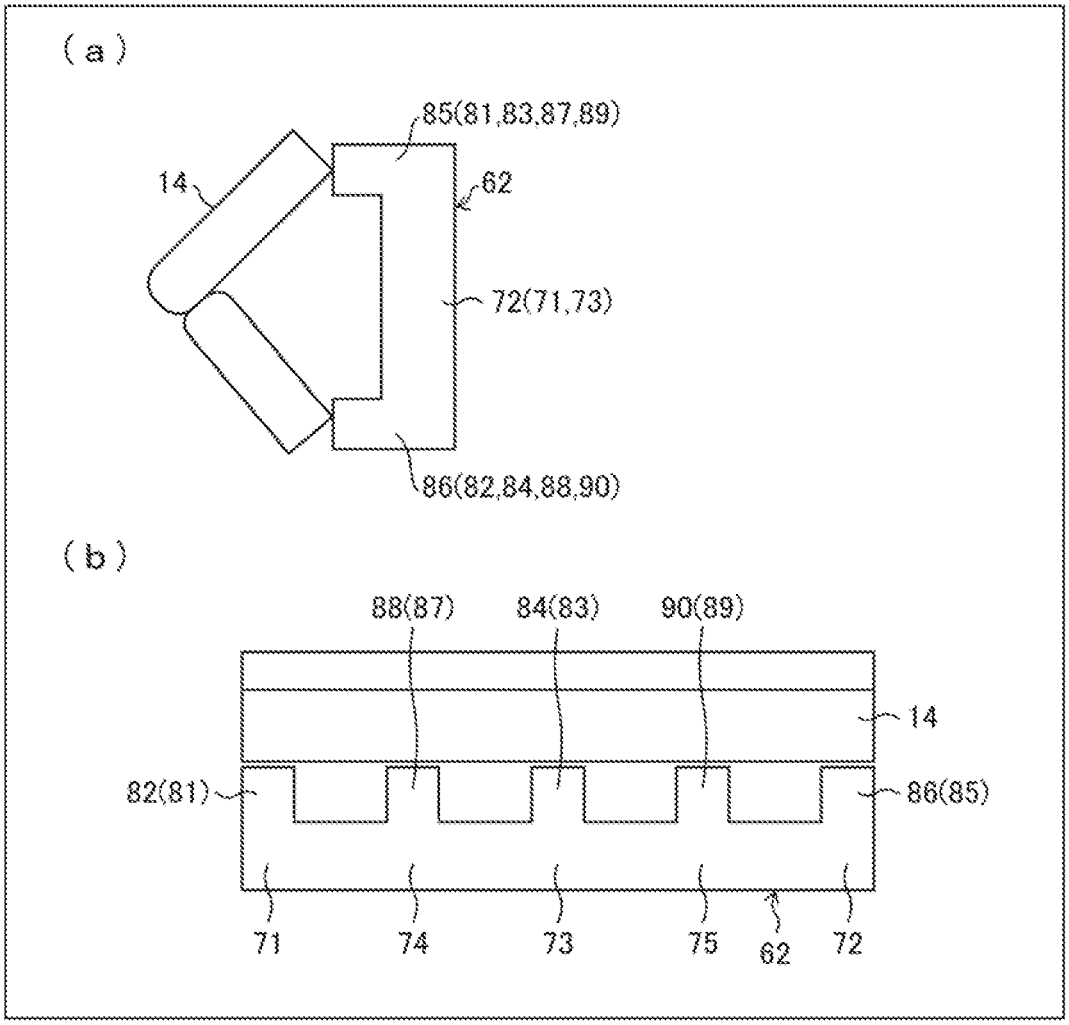
FIG. 9 (*a*) is a schematic side view illustrating a structure for supporting the heat exchanger with a cabinet of the indoor unit according to still another embodiment of the present invention.

FIG. 9 (*a*) is a schematic side view illustrating a structure for supporting the heat exchanger 14 by a cabinet 62 of the indoor unit 1 according to this embodiment. FIG. 9 (*b*) is a schematic bottom view illustrating the structure for supporting the heat exchanger 14 by the cabinet 62.

As illustrated in FIG. 9 (*b*), the indoor unit 1 of this embodiment includes the cabinet 62 instead of the cabinet 31. The cabinet 62 includes two cabinets 31 horizontally arranged. In the cabinet 62, the vertical right column 42, the upper right protrusion 46, and the lower right protrusion 47 of the cabinet 31 on the observer's left and the vertical left column 41, the upper left protrusion 44, and the lower left protrusion 45 of the cabinet 31 on the observer's right are formed in common.

Specifically, the cabinet 62 includes: a first vertical column 71 (corresponding to the vertical left column 41 of the cabinet 31 on the observer's left); a second vertical column 72 (corresponding to the vertical right column 42 of the cabinet 31 on the observer's right); a third vertical column 73 (corresponding to the vertical right column 42 of the cabinet 31 on the observer's left and the lower left protrusion 45 of the cabinet 31 on the observer's right); a fourth vertical column 74 (corresponding to the vertical middle column 43 of the cabinet 31 on the observer's left); and a fifth vertical column 75 (corresponding to the vertical middle column 43 of the cabinet 31 on the observer's right).

Moreover, the cabinet 62 includes: a first upper protrusion 81 (corresponding to the upper left protrusion 44 of the cabinet 31 on the observer's left), a first lower protrusion 82 (corresponding to the lower left protrusion 45 of the cabinet 31 on the observer's left); a second upper protrusion 83 (corresponding to the upper right protrusion 46 of the cabinet 31 on the observer's left and the upper left protrusion 44 of the cabinet 31 on the observer's right); a second lower protrusion 84 (corresponding to the lower right protrusion 47 of the cabinet 31 on the observer's left and the lower left protrusion 45 of the cabinet 31 on the observer's right); a third upper protrusion 85 (corresponding to the upper right protrusion 46 of the cabinet 31 on the observer's right); a third lower protrusion 86 (corresponding to the lower right protrusion 47 of the cabinet 31 on the observer's right); a fourth upper protrusion 87 (corresponding to the upper middle protrusion 48 of the cabinet 31 on the observer's left); a fourth lower protrusion 88 (corresponding to the lower middle protrusion 49 of the cabinet 31 on the observer's left); a fifth upper protrusion 89 (corresponding to the upper middle protrusion 48 of the cabinet 31 on the observer's right); and a fifth lower protrusion 90 (corresponding to the lower middle protrusion 49 of the cabinet 31 on the observer's right).

Similar to the lower middle protrusion 49 of the cabinet 31, the fourth lower protrusion 88 and the fifth lower protrusion 90 are respectively screwed to the fourth vertical column 74 and the fifth vertical 75. The fourth lower protrusion 88 and the fifth lower protrusion 90 can be unscrewed under, and removed from, the cabinet 62.

As illustrated in FIGS. 9 (*a*) and (*b*), in the indoor unit 1 of this embodiment, the heat exchanger 14 is supported by ten protrusions of the cabinet 62; namely, the first upper protrusion 81, the first lower protrusion 82, the second upper protrusion 83, the second lower protrusion 84, the third upper protrusion 85, the third lower protrusion 86, the fourth upper protrusion 87, the fourth lower protrusion 88, the fifth upper protrusion 89, and the fifth lower protrusion 90.

Note that, in this embodiment, the partition plate 33 is supported by the ten protrusions 81 to 90 of the cabinet 62. Moreover, the drain pan 34 is supported by the first lower protrusion 82, the second lower protrusion 84, the third lower protrusion 86, the fourth lower protrusion 88, and the fifth lower protrusion 90 of the cabinet 62.

Furthermore, as illustrated in FIG. 9 (*b*), the heat exchanger 14 of this embodiment has a length corresponding to the length of the cabinet 62; that is, the heat exchanger 14 is not horizontally separated. Alternatively, the heat exchanger 14 may be horizontally separated into two with the second upper protrusion 83 and the second lower protrusion 84 in the middle. The same goes for the other embodiments.

Figure 10:
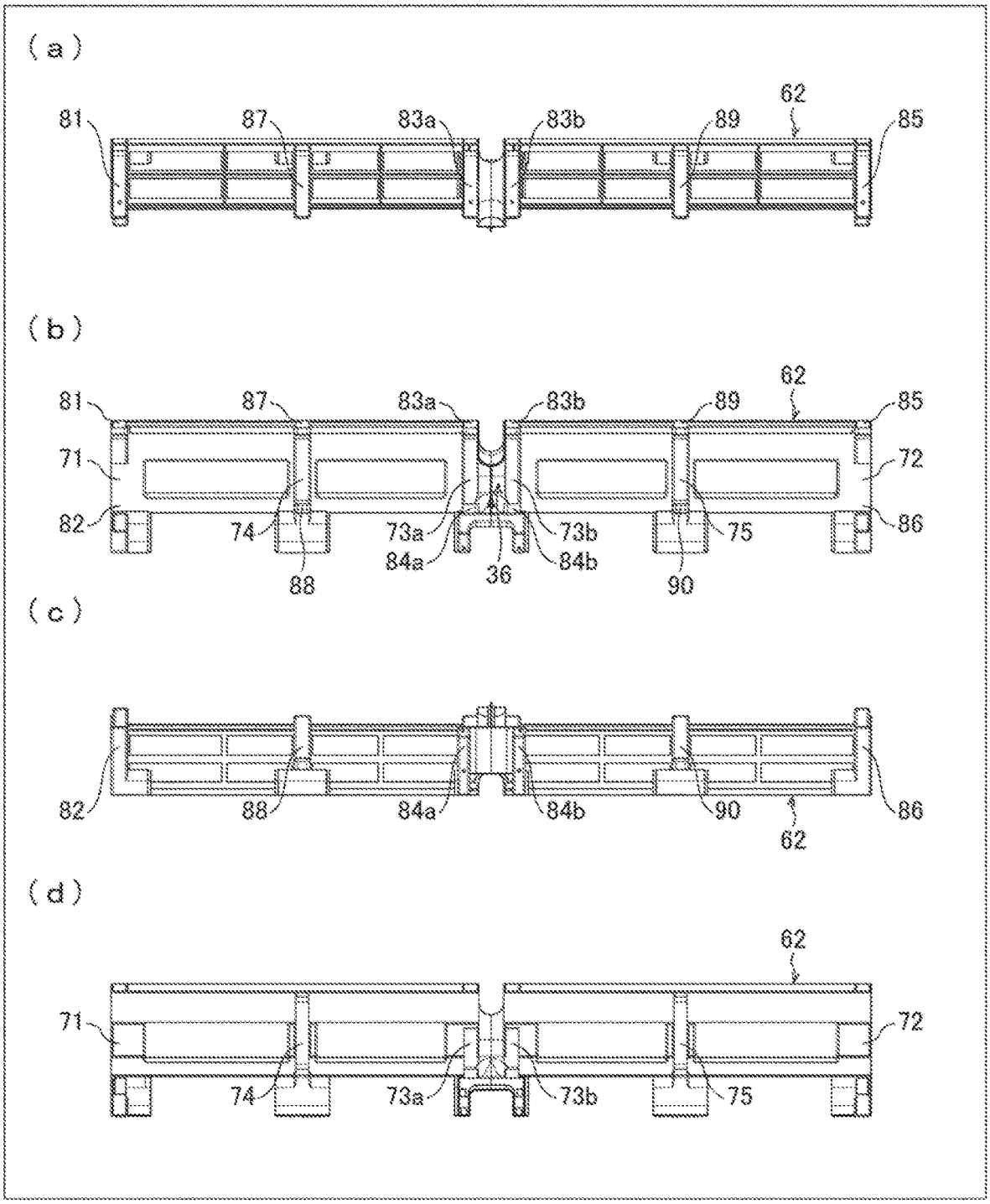
FIG. 10 (*a*) is a plan view illustrating a specific structure of the cabinet in FIG. 9.

FIG. 10 illustrates a specific structure of the cabinet 62. FIG. 10 (*a*) is a plan view illustrating a specific structure of the cabinet 62 in FIG. 9. FIG. 10 (*b*) is a front elevation of the cabinet 62. FIG. 10 (*c*) is a bottom view of the cabinet 62. FIG. 10 (*d*) is a rear elevation of the cabinet 62. Note that the cabinet 62 illustrated in FIG. 10 includes a motor accommodation 36 in the horizontal middle (in which the third vertical column 73, the second upper protrusion 83 and the second lower protrusion 84 are positioned) of the cabinet 62. Hence, the third vertical column 73, the second upper protrusion 83, and the second lower protrusion 84 illustrated in FIG. 9 are horizontally divided and respectively illustrated as third vertical columns 73*a* and 73*b*, second upper protrusions 83*a* and 83*b*, and second lower protrusions 84*a* and 84*b*.

A fan motor accommodated in the motor accommodation 36 is a dual-shaft motor having rotation shafts longitudinally aligned. One dual-shaft motor rotates four air-blowing fans 13. Note that, the motor accommodation 36 may accommodate two single-shaft fan motors each having a rotation shaft on one side alone, so that one of the fan motors may rotate two of the air-blowing fans 13 on the left and the other one of the fan motors may rotate the other two air-blowing fans 13 on the right. Alternatively the motor accommodation 36 may be placed not in the position illustrated in FIG. 10; instead, motor accommodations 36 included in the motor accommodation 36 may be each located between the fourth upper protrusion 87 and the fourth lower protrusion 88 and between the fifth upper protrusion 89 and the fifth lower protrusion 90. Each of the motor accommodations 36 may accommodate a dual-shaft fan motor, so that each fan motor may rotate two of the air-blowing fans 13.

(Advantages of Indoor Unit)

The cabinet 62 included in the indoor unit 1 of this embodiment s laterally twice as long as the cabinet 31 in FIG. 7 and the cabinet 61 in FIG. 8. Hence, the cabinet 62 is provided with four fan casings 32 and four air-blowing fan 13.

Thus, when the indoor-unit body 2 has the first inlet 11, the first filter 15 (a filter with relatively low performance), the second inlet 12, and the second filter 16 (a filter with relatively high performance) as illustrated in, for example, FIG. 2, the above configuration makes it possible to obtain a sufficient volume of air in the air purification mode using the second inlet 12 and second filter 16, contributing to achieving high air purification performance. The other advantages of the indoor unit 1 according to this embodiment are the same as those of the indoor unit 1 including the cabinet 31 according to the first embodiment.

Fourth Embodiment

Described below is still another embodiment of the present invention, with reference to the drawings. Note that, for the sake of explanation, identical reference signs are used to denote components with identical functions between the preceding embodiments and a fourth embodiment. Such components will not be elaborated upon here.

(Structure for Supporting Heat Exchanger 14 by Cabinet 63)

Figure 11:
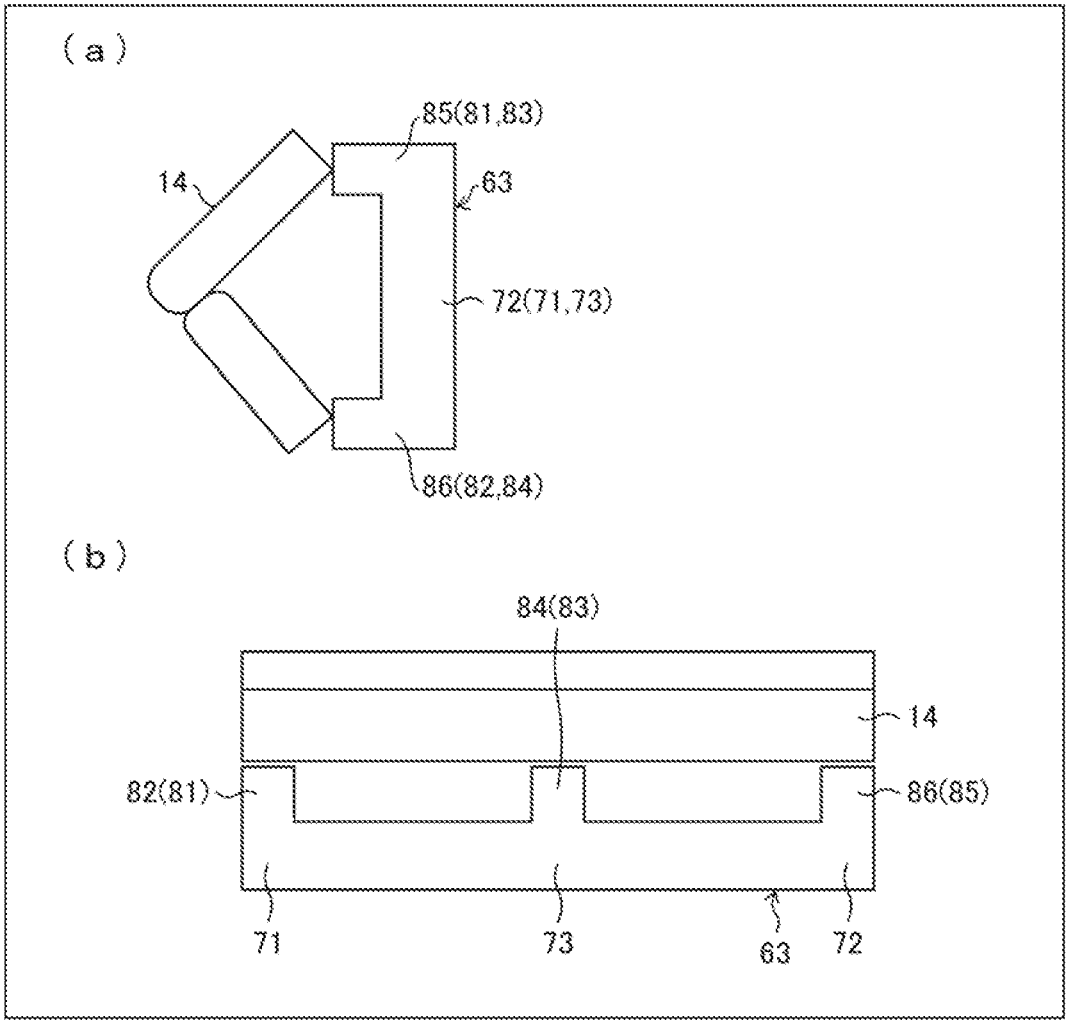
FIG. 11 (*a*) is a schematic side view illustrating a structure for supporting the heat exchanger with a cabinet of the indoor unit according to still another embodiment of the present invention.

FIG. 11 (*a*) is a schematic side view illustrating a structure for supporting the heat exchanger 14 with a cabinet 63 of an indoor unit 1 according this embodiment. FIG. 11 (*b*) is a schematic bottom view illustrating the structure for supporting the heat exchanger 14 by the cabinet 63.

The indoor unit 1 of this embodiment includes the cabinet 63 instead of the cabinet 62 illustrated in FIG. 9. As illustrated in FIGS. 11 (*a*) and (*b*), in the indoor unit 1 of this embodiment, the heat exchanger 14 is supported by six protrusions of the cabinet 63; namely, the first upper protrusion 81, the first lower protrusion 82, the second upper protrusion 83, the second lower protrusion 84, the third upper protrusion 85, and the third lower protrusion 86.

Note that, in this embodiment, the partition plate 33 is supported by the six protrusions 81 to 86 of the cabinet 63. Moreover, the drain pan 34 is supported by the first lower protrusion 82, the second lower protrusion 84, and the third lower protrusion 86 of the cabinet 63.

(Advantages of Indoor Unit)

The cabinet 63 included in the indoor unit 1 of this embodiment is laterally twice as long as the cabinet 31 in FIG. 7 and the cabinet 61 in FIG. 8. Hence, the cabinet 62 is provided with four fan casings 32 and four air-blowing fan 13.

Thus, when the indoor-unit body 2 has the first inlet 11, the first filter 15 (a filter with relatively low performance), the second inlet 12, and the second filter 16 (a filter with relatively high performance) as illustrated in, for example, FIG. 2, the above configuration makes it possible to obtain a sufficient volume of air in the air purification mode using the second inlet 12 and second filter 16, contributing to achieving high air purification performance. The other advantages of the indoor unit 1 according to this embodiment are the same as those of the indoor unit 1 including the cabinet 61 according to the first embodiment.

CONCLUSION

The indoor unit, for the air conditioner, according to a first aspect of the present invention includes: the heat exchanger 14, an inlet (the first inlet 11 and the second inlet 12), the outlet 17, the air-blowing fan 13, and the cabinet 31, wherein the heat exchanger 14 is placed only in front of a rotation center of the air-blowing fan 13, the inlet is provided in rear of the heat exchanger 14, the outlet 17 is provided in front of the heat exchanger 14, the air-blowing fan 13 blows air, sucked from the inlet, at the heat exchanger 14, and blows the air out from the outlet 17, and the cabinet 31 includes: an upper protrusion (the upper left protrusion 44 and the upper right protrusion 46) protruding forward from an upper portion of the cabinet 31; and a lower protrusion (the lower left protrusion 45 and the lower right protrusion 47) protruding forward from a lower portion of the cabinet 31, the upper protrusion and the lower protrusion supporting the heat exchanger 14.

In the above configuration, the heat exchanger 14 is placed only in front of the rotation center of the air-blowing fan 13. The air-blowing fan 13 blows air sucked from an inlet at the heat exchanger 14, and blows the air out from the outlet 17. The cabinet 31 has an upper protrusion protruding forward from an upper portion of the cabinet 31, and a lower protrusion protruding forward from a lower portion of the cabinet 31. These upper protrusion and lower protrusion support the heat exchanger 14.

Hence, even though the heat exchanger 14 is placed only in front of the rotation center of the air-blowing fan 13, the cabinet 31 can appropriately support the heat exchanger 14.

In the indoor unit, for the air conditioner, of a second aspect of the present invention according to the first aspect, the air-blowing fan 13 may be placed between the upper protrusion and the lower protrusion of the cabinet, and the tower protrusion may include the lower left protrusion 45 and the lower right protrusion 47 respectively provided on a left side and a right side of the cabinet 31.

In the above configuration, the air-blowing fan 13 is placed between the upper protrusion and the lower protrusion of the cabinet 31. The lower protrusion includes the lower left protrusion 45 and the lower right protrusion 47 respectively provided on the left and the right of the cabinet 31. Hence, when the air-blowing fan 13 is cleaned, for example, the air-blowing fan 13 can be easily taken out downward between the lower left protrusion 45 and the lower right protrusion 47.

In the indoor unit, for the air conditioner, of a third aspect of the present invention according to the second aspect, the air-blowing fan 13 may include a plurality of air-blowing fans 13 horizontally arranged in the cabinet 31, and, between the fans 13, a motor accommodation 36 may be provided to accommodate a motor to rotate the air-blowing fans 13.

In the above configuration, the air-blowing fan 13 includes a plurality of air-blowing fans 13 arranged horizontally. The air-blowing fans 13 have a motor accommodation 36 therebetween accommodating a motor to rotate the air-blowing fans 13. Hence, when the motor accommodated in the motor accommodation 36 is, for example, broken, and the broken motor is to be repaired or replaced, the motor can be easily taken out downward between the lower left protrusion 45 and the lower right protrusion 47, as the air-blowing fan 13 is done so.

In the indoor unit, for the air conditioner, of a fourth aspect of the present invention, according to the second aspect or the third aspect, the lower protrusion may include a lower middle protrusion 49 provided removably between the lower left protrusion 45 and the lower right protrusion 47.

When the air-blowing fan 13 alone is placed between the upper protrusion and the lower protrusion of the cabinet 31, the lower middle protrusion 49 in the above configuration can reduce the risk of the air-blowing fan 13 falling down between the lower left protrusion 45 and the lower right protrusion 47, and enhance the rigidity of the cabinet 31 to support the heat exchanger 14. Moreover, the lower middle protrusion 49 is removed so that the air-blowing fan 13 can be easily taken out downward between the lower left protrusion 45 and the lower right protrusion 47.

When the air-blowing fan 13 and a motor are placed between the upper protrusion and the lower protrusion of the cabinet 31, the lower middle protrusion 49 in the above configuration can reduce the risk of the air-blowing fan 13 and the motor falling down between the lower left protrusion 45 and the lower right protrusion 47, and enhance the rigidity of the cabinet 31 to support the heat exchanger 14. Furthermore the lower middle protrusion 49 is removed so that the air-blowing fan 13 and the motor can be easily taken out downward between the lower left protrusion 45 and the lower right protrusion 47.

In the indoor unit, for the air conditioner, of a fifth aspect of the present invention according to any one of the first to fifth aspects, the lower protrusion may be connected to a drain pan 34, and the heat exchanger 14 may be provided above the drain pan 34.

In the above configuration, the tower protrusion is connected to the drain pan 34, and the heat exchanger 14 is provided above the drain pan 34. Hence, also the drain pan 34 can support the weight of the heat exchanger 14, making it possible to enhance the support of the heat exchanger 14.

In the indoor unit, for the air conditioner, of a sixth aspect of the present invention according to any one of the first to fifth aspects, the heat exchanger 14 may be attached to a heat exchanger attachment (the partition plate 33), and supported by the cabinet 31 through the heat exchanger attachment.

In the above configuration, the heat exchanger attachment allows the heat exchanger 14 to be easily placed in front of the cabinet 31.

In the indoor unit, for the air conditioner, of a seventh aspect of the present invention according to any one of the first to sixth aspects, the inlet may include: a first inlet 11 provided in rear of, and above, the heat exchanger 14; and a second inlet 12 provided in rear of, and below, the heat exchanger 14, and the first inlet 11 may be provided with a first filter 15 and an open-close lid 18 to open and close the first inlet 11, and the second inlet 12 may be provided with a second filter 16 greater in air-flow resistance than the first filter 15.

In the above configuration, the indoor unit includes the first inlet 11, the first filter 15, the second inlet 12 and the second filter 16 in rear of the heat exchanger 14, The heat exchanger 14 is placed only in front of the rotation center of the air-blowing fan 13, and is supported by the protrusions of the cabinet 31. The air-blowing fan 13 blows the air, sucked from the first inlet 11 and the second inlet 12, at the heat exchanger 14, and blows out the air from the outlet 17. Hence, the indoor unit can carry out operations of conditioning air using the first filter 15 and purifying air using the second filter 16, prioritizing one over the other. In a configuration to achieve such a function, the components of the indoor unit are laid out in a good manner.

The present invention shall not be limited to the embodiments described above, and can be modified in various manners within the scope of claims. The technical aspects disclosed in different embodiments are to be appropriately combined together to implement an embodiment. Such an embodiment shall be included within the technical scope of the present invention. Moreover, the technical aspects disclosed in each embodiment are combined to achieve a new technical feature.

REFERENCE SIGNS LIST

1 Indoor Unit
2 Indoor-Unit Body
3 Air Guiding Plate
11 First Inlet
12 Second Inlet
13 Air-Blowing Fan
14 Heat Exchanger
15 First Filter
16 Second Filter
17 Outlet
18 Open-Close Lid
31,61,62,63 Cabinet
32 Fan Casing
33 Partition Plate (Heat Exchanger Attachment)
34 Drain Pan
36 Motor Accommodation
41 Vertical Left Column
42 Vertical Right Column
43 Vertical Middle Column
44 Upper Left Protrusion (Upper Protrusion)
45 Lower Left Protrusion (Lower Protrusion)
46 Upper Right Protrusion (Upper Protrusion)
47 Lower Right Protrusion (Lower Protrusion)
48 Upper Middle Protrusion (Upper Protrusion)
49 Lower Middle Protrusion (Lower Protrusion)
71 to 75 First to Fifth Vertical Columns
81,83,85,87,89 First to Fifth Upper Protrusions (Upper Protrusions)
82,84,86,88,90 First to Fifth Lower Protrusions (Lower Protrusions)

The invention claimed is:

1. An indoor unit for an air conditioner, the indoor unit comprising:

a heat exchanger, an inlet, an outlet, an air-blowing fan, a fan motor to drive the air-blowing fan, and a cabinet, wherein the heat exchanger is placed only in front of a rotation center of the air-blowing fan, the inlet is provided in rear of the heat exchanger, the outlet is provided in front of the heat exchanger, the air-blowing fan blows air, sucked from the inlet, at the heat exchanger, and blows the air out from the outlet, the cabinet includes: an upper protrusion protruding forward from an upper portion of the cabinet; and a lower protrusion protruding forward from a lower portion of the cabinet, the upper protrusion and the lower protrusion supporting the heat exchanger, the air-blowing fan and the fan motor are placed below the upper protrusion of the cabinet and above the lower protrusion of the cabinet, the lower protrusion includes a lower left protrusion and a lower right protrusion respectively provided on a left side and a right side of the cabinet, and an opening is formed that allows at least the fan motor to be taken out downward between the lower left protrusion and the lower right protrusion while the heat exchanger is supported by the lower left protrusion and the lower right protrusion.

2. The indoor unit according to claim 1, wherein the air-blowing fan includes a plurality of air-blowing fans horizontally arranged in the cabinet, and, between the plurality of air-blowing fans, a motor accommodation is provided to accommodate the fan motor to rotate the plurality of air-blowing fans.

3. The indoor unit according to claim 1, wherein the lower protrusion further includes a lower middle protrusion provided removably between the lower left protrusion and the lower right protrusion.

4. The indoor unit according to claim 1, wherein the lower protrusion is connected to a drain pan, and the heat exchanger is provided above the drain pan.

5. The indoor unit according to claim 1, wherein the heat exchanger is attached to a heat exchanger attachment, and supported by the cabinet through the heat exchanger attachment.

6. An indoor unit for an air conditioner, the indoor unit comprising:

a heat exchanger, an inlet, an outlet, an air-blowing fan, a fan motor to drive the air-blowing fan, and a cabinet, wherein the air-blowing fan and the fan motor are housed in the cabinet, the cabinet has a left protrusion protruding forward from a left side of the cabinet and a right protrusion protruding forward from a right side of the cabinet, and causes the left protrusion and the right protrusion to support the heat exchanger at or near the outlet, and an opening that allows at least the fan motor to be taken out downward is formed between a lower portion of the left protrusion and a lower portion of the right protrusion.

7. An indoor unit for an air conditioner, the indoor unit comprising:

a heat exchanger, an inlet, an outlet, an air-blowing fan, and a cabinet, wherein the heat exchanger is placed only in front of a rotation center of the air-blowing fan, the inlet is provided in rear of the heat exchanger, the outlet is provided in front of the heat exchanger, the air-blowing fan blows air, sucked from the inlet, at the heat exchanger, and blows the air out from the outlet, the cabinet includes: an upper protrusion protruding forward from an upper portion of the cabinet; and a lower protrusion protruding forward from a lower portion of the cabinet, the upper protrusion and the lower protrusion supporting the heat exchanger, and the inlet includes: a first inlet provided in rear of, and above, the heat exchanger; and a second inlet provided in rear of, and below, the heat exchanger.

* * * * *